US007505899B2

(12) United States Patent
Serizawa

(10) Patent No.: US 7,505,899 B2
(45) Date of Patent: Mar. 17, 2009

(54) SPEECH CODE SEQUENCE CONVERTING DEVICE AND METHOD IN WHICH CODING IS PERFORMED BY TWO TYPES OF SPEECH CODING SYSTEMS

(75) Inventor: Masahiro Serizawa, Tokyo (JP)

(73) Assignee: NEC Corporation, Tokyo (JP)

( * ) Notice: Subject to any disclaimer, the term of this patent is extended or adjusted under 35 U.S.C. 154(b) by 969 days.

(21) Appl. No.: 10/467,012

(22) PCT Filed: Feb. 1, 2002

(86) PCT No.: PCT/JP02/00843

§ 371 (c)(1),
(2), (4) Date: Aug. 4, 2003

(87) PCT Pub. No.: WO02/063610

PCT Pub. Date: Aug. 15, 2002

(65) Prior Publication Data

US 2004/0068407 A1 Apr. 8, 2004

(30) Foreign Application Priority Data

Feb. 2, 2001 (JP) ..... 2001-26906

(51) Int. Cl.
*G10L 19/04* (2006.01)
*G10L 11/04* (2006.01)

(52) U.S. Cl. ..... 704/219; 704/207

(58) Field of Classification Search ..... 704/207, 704/219

See application file for complete search history.

(56) References Cited

U.S. PATENT DOCUMENTS 6,260,009 B1 * 7/2001 Dejaco ..... 704/221
6,498,811 B1 * 12/2002 Van Der Vleuten ..... 375/240
6,910,009 B1 * 6/2005 Murashima ..... 704/225
6,917,916 B2 * 7/2005 Curtis et al. ..... 704/228
2002/0077812 A1 * 6/2002 Suzuki et al. ..... 704/230
2006/0041431 A1 * 2/2006 Maes ..... 704/270.1

FOREIGN PATENT DOCUMENTS

| | | |
|---|---|---|
| JP | 1-97997 | 4/1989 |
| JP | 1-211798 | 8/1989 |
| JP | 4-147300 | 5/1992 |
| JP | 5-289700 | 11/1993 |
| JP | 6-266399 | 9/1994 |

(Continued)

*Primary Examiner*—Talivaldis Ivars Smits
(74) *Attorney, Agent, or Firm*—Young & Thompson

(57) ABSTRACT

A voice code sequence converting device and method for converting a code sequence with low computational complexity by receiving a first code sequence having a pitch period at an input terminal on the input side, converting the first code sequence into a second code sequence having a pitch period, and outputting the second code sequence from an output terminal on the output side. In addition to a circuit for synthesizing a decoded signal from a code sequence of the CELP method on the input side, the voice code sequence converting device has a circuit for directly delivering the LP coefficient and pitch period decoded by an LP coefficient decoding circuit and a pitch component decoding circuit respectively to an LP coefficient encoding circuit and a pitch component calculating circuit on the output side respectively so as to deliver them to code sequence conversion of the output side.

12 Claims, 9 Drawing Sheets

FOREIGN PATENT DOCUMENTS

| | | |
|---|---|---|
| JP | 08-123495 | 5/1996 |
| JP | 8-1466997 | 6/1996 |
| JP | 09-172413 | 6/1997 |
| JP | 10-031499 | 2/1998 |
| JP | 10-91193 | 4/1998 |
| JP | 10-143196 | 5/1998 |
| JP | 10-161699 | 6/1998 |
| JP | 11-95796 | 4/1999 |
| JP | 11-272298 | 10/1999 |
| JP | 2000-163097 | 6/2000 |
| WO | WO 00/48170 | 8/2000 |

* cited by examiner

SPEECH CODE SEQUENCE CONVERTING DEVICE AND METHOD IN WHICH CODING IS PERFORMED BY TWO TYPES OF SPEECH CODING SYSTEMS

TECHNICAL FIELD

The present invention relates to a code sequence conversion apparatus and code sequence conversion method in which in speech communication performed between two types of speech coding systems, a speech code sequence obtained by one system of coding is converted to a speech code sequence which can be decoded by the other system, particularly to a speech code sequence conversion apparatus and code sequence conversion method in which the speech code sequence can be converted with low strain and small calculation amount.

BACKGROUND ART

As a speech coding system which has heretofore been used most frequently in a cellular phone, there is a code excited linear prediction (CELP) system. As a document in which the CELP system is described, there is "Code-Excited Linear Prediction: High Quality Speech at Very Low Bit Rates" (IEEE Proc. ICASSP-85, pp. 937 to 940, 1985) (hereinafter referred to as Reference Document 1).

In a coding apparatus by the CELP system, a linear prediction (LP) coefficient and excitation signal are separately coded. The LP coefficient indicates a spectrum envelope characteristic obtained by subjecting an input speech signal to a linear prediction (LP) analysis and calculation. The excitation signal drives an LP synthesis filter constituted of the LP coefficient. The LP analysis and the coding of the LP coefficient are carried out for each frame which has a predetermined length. This frame is further divided into sub-frames, and the excitation signal to be coded is coded for each sub-frame.

Here, the excitation signal is constituted of a period component indicating a pitch period of an input signal, remaining residual error components, and gains of the components. The period component indicating a pitch period of the input signal is represented by an adaptive code vector stored in a codebook which is called an adaptive codebook and which holds the past excitation signal. The residual error component is represented by a multi-pulse signal constituted of a plurality of pulses called a speech source code vector or a pre-designed signal. Information of the speech source code vector is accumulated in a speech source codebook.

In a decoding apparatus by the CELP system, the decoded pitch period component and the excitation signal calculated from the residual error signal are inputted into the synthesis filter constituted of the decoded LP coefficient to obtain a synthesized speech signal.

As the conventional conversion apparatus for converting the speech code sequence obtained by one system of coding into the speech code sequence decodable by the other system in the communication between two different CELP systems, there is a conversion apparatus in which a speech signal decoded from the speech code sequence inputted from the decoding apparatus of one CELP system is coded in the other CELP system to obtain an output speech code sequence.

Next, this type of conversion apparatus of the speech code sequence which has heretofore been used will be described with reference to FIG. 1. FIG. 1 is a block diagram showing one constitution example of the conversion apparatus which converts the speech code sequence of one CELP system A into that of the other CELP system B.

The shown conversion apparatus includes an input terminal 10, demultiplexer circuit 11, LP coefficient decoding circuit 12, pitch component decoding circuit 113, residual error component decoding circuit 14, and speech synthesis circuit 15 for decoding processing of the CELP system A. A frame circuit 21, sub-frame circuit 22, LP analysis circuit 130, LP coefficient coding circuit 31, pitch period candidate selection circuit 132, pitch component coding circuit 41, residual error component coding circuit 51, excitation signal synthesis circuit 52, multiplexer circuit 53, and output terminal 50 are disposed to carry out coding processing of the CELP system B.

The input terminal 10 inputs the code sequence of the CELP system A for each frame of the CELP system A, and transfers the sequence to the demultiplexer circuit 11. The demultiplexer circuit 11 separates each code from the code sequence transferred from the input terminal 10. The demultiplexer circuit 11 separates the code of the separated quantization LP coefficient to transfer the code to the LP coefficient decoding circuit 12, transfers the code of the pitch period to the pitch component decoding circuit 113, and further transfers the code of the residual error component signal to the residual error component decoding circuit 14.

The LP coefficient decoding circuit 12 uses the code transferred from the demultiplexer circuit 11 to decode the LP coefficient indicating a spectrum characteristic, and transfers the decoded coefficient to the speech synthesis circuit 15.

As a coding method and decoding method of the LP coefficient, there is a method of performing vector quantization of the LP coefficient after change into a line spectrum pair (LSP). In the vector quantization, a coding unit and decoding unit have the same quantization vector table, and the code attached to each vector is transmitted. The decoding unit outputs the vector corresponding to the transferred code. For details of a vector quantization method of LSP, "Efficient Vector Quantization of LPC Parameters at 24 Bits/Frame" (IEEE Proc. ICASSP-91, pp. 661 to 664, 1991) (hereinafter referred to as Reference Document 2) can be referred to.

The pitch component decoding circuit 113 decodes a pitch period L and pitch gain ga from the code transferred from the demultiplexer circuit 11. The pitch period L and pitch gain ga are scalar-quantized, and a value corresponding to the transferred code is retrieved from a pre-designed quantization table to obtain a decoded value. The pitch component decoding circuit 113 accumulates the excitation signal transferred from the speech synthesis circuit 15 up to a sample with respect to the past pitch period L, and traces back and cuts out the accumulated excitation signals for the past pitch period L to prepare an adaptive code vector Ca. Finally, a pitch component signal Ea (=ga·Ca) is calculated, and transferred to the speech synthesis circuit 15.

The residual error component decoding circuit 14 uses the code transferred from the demultiplexer circuit 11 to decode a speech source code vector Cr and speech source gain gr, calculates a residual error component signal Er (=gr·Cr), and transfers the signal to the speech synthesis circuit 15. The speech source gain gr is scalar-quantized, and the value corresponding to the transferred code is retrieved from the pre-designed quantization table to obtain the decoded value. For the speech source code vector Cr, the vector corresponding to the transferred code is retrieved from the speech source codebook prepared beforehand to obtain a decoded vector.

The speech synthesis circuit 15 uses the pitch component signal Ea transferred from the pitch component decoding circuit 113 and the residual error component signal Er transferred from the residual error component decoding circuit 14 to calculate an excitation signal vector Ex of the following equation 1, and transfers a calculated result to the pitch component decoding circuit 113.

$$Ex=Ea+Er=ga\cdot Ca+gr\cdot Cr \tag{1}$$

Furthermore, the speech synthesis circuit 15 uses a synthesis filter H(z) constituted of an LP coefficient a(i) transferred from the LP coefficient decoding circuit 12 and shown in the following equation 2 to filter the excitation signal vector Ex calculated beforehand, obtains the decoded signal of the CELP system A, and transfers the decoded signal to the frame circuit 21.

$$H(z)=\frac{1}{1+\sum_{i=1}^{p}a(i)z^{-1}} \tag{2}$$

In Equation 2, "p" denotes an order of the LP coefficient.

In order to enhance an auditory speech quality in the CELP system, a filter, called a post filter, for emphasizing a spectrum peak is used with respect to the decoded signal. However, when the coding is carried out again, coding strain is increased, and therefore this post filter is not applied.

The frame circuit 21 cuts the decoded signal transferred from the speech synthesis circuit 15 by a frame length of the CELP system B, and transfers the signals to the LP analysis circuit 130, pitch period candidate selection circuit 132, and sub-frame circuit 22. The sub-frame circuit 22 divides the decoded signal transferred from the frame circuit 21 into sub-frame lengths of the CELP system B, and transfers the signals to the pitch component coding circuit 41.

The LP analysis circuit 130 LP-analyzes the decoded signal transferred from the frame circuit 21 to obtain the LP coefficient. Next, the LP analysis circuit 130 transfers the obtained LP coefficient to the LP coefficient coding circuit 30 and pitch period candidate selection circuit 132.

The LP coefficient coding circuit 31 vector-quantizes the LP coefficient transferred from the LP analysis circuit 130, and transfers the code to the multiplexer circuit 53. For this quantization method, Reference Document 2 described above can be referred to. Furthermore, the LP coefficient coding circuit 31 transfers the quantized LP coefficient to the pitch component coding circuit 41 and residual error component coding circuit 51.

The pitch period candidate selection circuit 132 uses the decoded signal transferred from the frame circuit 21 to select a candidate of the pitch period, and transfers the candidate to the pitch component coding circuit 41. To select the candidate, first the decoded signal transferred from the frame circuit 21 is filtered by a load filter W(z) constituted of the LP coefficient a(i) transferred from the LP analysis circuit 130 and shown in the following equation 3. In Equation 3, "β" and "γ" denote coefficients for adjusting a load degree to improve the auditory speech quality and take values which satisfy "$0<\gamma<\beta\leqq 1$".

$$W(z)=\frac{1+\sum_{i=1}^{p}\beta^{i}a(i)z^{-1}}{1+\sum_{i=1}^{p}\gamma^{i}a(i)z^{-1}} \tag{3}$$

Next, the pitch period candidate selection circuit 132 calculates a self correlation function of the load decoded signal in a range of correlation lags "20 to 147", and selects a correlation lag in which the self correlation is maximized and a neighboring value as the candidates of the pitch period.

The pitch component coding circuit 41 codes the pitch period component of a decoded signal vector Sd which has been transferred from the sub-frame circuit 22 and which corresponds to the sub-frame length for each sub-frame, and transfers the code to the multiplexer circuit 53. The pitch component coding circuit 41 first traces back the excitation signal which has been transferred from the residual error component coding circuit 51 and which was decoded in the past for a time L and cuts the signal by the sub-frame length to prepare the adaptive code vector. Next, the pitch component coding circuit 41 filters this adaptive code vector by Equation 2 described above, and calculates a decoded signal Sa(L) of only the pitch component. Furthermore, the pitch component coding circuit 41 uses Equation 3 described above to load the decoded signal vector Sd and pitch period component vector Sa(L) to obtain a load decoded signal vector Sdw and load pitch period component vector Saw(L).

The pitch component coding circuit 41 performs an operation concerning the above-described pitch period component with respect to each candidate of the pitch period transferred from the pitch period candidate selection circuit 132, and determines an optimum pitch period Lo in which a square distance Da between the load decoded signal vector Sdw and load pitch period component vector Saw(L) is minimized. The square distance Da is obtained by the following equation 4 using an optimum pitch gain ga(L) calculated for each pitch period L. The optimum pitch gain ga(L) is obtained by the following equation 5. Here, in the following description, symbol ||x|| means a norm of a vector x, and symbol <x, y> means an inner product of vectors x and y, respectively $$Da=|Sdw-ga(L)\cdot Saw(L)| \tag{4}$$

$$ga(L)=\langle Sdw, Saw(L)\rangle/|Saw(L)| \tag{5}$$

The pitch component coding circuit 41 finally transfers the code obtained by the scalar quantization of the optimum pitch period Lo and the corresponding pitch gain ga(Lo) to the multiplexer circuit 53.

Moreover, the pitch component coding circuit 41 transfers a residual error signal vector Sdw' obtained by subtracting the vector obtained by integrating a load pitch period component vector Saw(Lo) with a quantized optimum pitch gain gaq(Lo) from the load decoded signal vector Sdw to the residual error component coding circuit 51. Furthermore, the pitch component coding circuit 41 transfers a pitch component excitation signal E'a obtained by integrating an adaptive code vector Ca(Lo) corresponding to the optimum pitch period Lo with the quantized optimum pitch gain gaq(Lo) to the excitation signal synthesis circuit 52.

The residual error component coding circuit 51 codes the residual error signal vector Sdw' transferred as the residual error component of the decoded signal vector Sd from the pitch component coding circuit 41 for each sub-frame, and transfers the code to the multiplexer 53.

That is, the residual error component coding circuit 51 first takes a k-th speech source code vector Cr(k) from the predesigned and accumulated speech source codebook. Next, the residual error component coding circuit 51 filters the speech source code vector by Equation 2 described above, and calculates a decoded signal Sr(k) of only the residual error component. Furthermore, the residual error component coding circuit 51 uses Equation 3 described above to load the decoded signal vector Sd and residual error component vector Sr(k), and obtains the load decoded signal vector Sdw and loaded residual error component vector Srw(k). The residual error component coding circuit 51 performs the operation concerning the above-described residual error component with respect to all the speech source code vectors accumulated in the speech source codebook, and determines a code ko of the speech source code vector so that a square distance Dr between the residual error signal vector Sdw' and load residual error component vector Srw(k) transferred from the pitch component coding circuit 41 is minimized.

The square distance Dr is obtained by the following equation 6 using an optimum speech source gain gr(k) calculated for each delay. The optimum speech source gain gr(k) is obtained by the following equation 7.

$$Dr=|Sdw'-gr(K)\cdot Srw(K)| \tag{6}$$

$$gr(K)=<Sdw, Srw(k)>/|Srw(k)| \tag{7}$$

Finally, the residual error component coding circuit 51 scalar-quantizes an optimum speech source gain gr(ko), and transfers the code and the code ko of the speech source code vector to the multiplexer circuit 53. The residual error component coding circuit 51 transfers a residual error component excitation signal E'r obtained by integrating a selected speech source code vector Cr(ko) with the quantized optimum speech source gain grq(ko) to the excitation signal synthesis circuit 52.

The excitation signal synthesis circuit 52 adds a pitch component excitation signal E'a transferred from the pitch component coding circuit 41 and the residual error component excitation signal E'r transferred from the residual error component coding circuit 51 to calculate an excitation signal Ex' by the following equation 8, and transfers the signal to the pitch component coding circuit 41.

$$\begin{aligned} Ex' &= E'a + E'r \\ &= gaq(Lo)\cdot Ca(Lo) + grq(ko)\cdot Cr(ko) \end{aligned} \tag{8}$$

The multiplexer circuit 53 connects the codes to one another in a predetermined order, which have been transferred from the LP coefficient coding circuit 31, pitch component coding circuit 41, and residual error component coding circuit 51 and obtained by the coding, to produce the code sequence, and transfers the sequence to the output terminal 50. The output terminal 50 outputs the code sequence transferred from the multiplexer circuit 53.

However, the above-described conversion apparatus of the speech code sequence is unfavorable, because a code conversion processing amount is large and enlargement cannot be avoided.

A reason for this is that the code sequence concerning all parameters is converted via the synthesized decoded signal, when the decoded signal obtained by synthesizing the code sequence coded by the CELP system A on an input side from the demultiplexer circuit via the decoding circuit is coded by the CELP system B on an output side through the frame circuit.

Therefore, an object of the present invention is to provide a conversion apparatus of a speech code sequence and a method in which a speech code sequence to be inputted is decoded and converted into another speech code sequence without increasing a strain and the sequence can be converted with a small calculation amount.

DISCLOSURE OF THE INVENTION

According to the present invention, there is provided a speech code sequence conversion apparatus comprising a circuit constitution including: a decoding circuit for a first code sequence, which speech-synthesizes codes separated and decoded into the codes of a quantization linear prediction (LP) coefficient, pitch period, and residual error component signal from the first code sequence including the pitch period to be inputted to produce a decoded signal; and a coding circuit for a second code sequence, which cuts the decoded signal by a frame length of the second code sequence, further divides the frame length into sub-frame lengths, vector-quantizes the LP coefficient to produce a quantized LP coefficient, codes a pitch component into an optimum pitch, and codes and synthesizes calculated and obtained residual error components to output a coded signal.

For the speech code sequence conversion apparatus according to the present invention, in the above-described apparatus, when the first code sequence is converted into a second code sequence, the LP coefficient decoded from the first code sequence is used as an LP analysis result with respect to the second code sequence. As a result, in second code sequence processing, LP analysis processing with respect to the decoded signal is unnecessary. The pitch period decoded by the first code sequence or the pitch period in the vicinity are used as pitch period candidates in the second code sequence. As a result, in the second code sequence processing, selection processing of the pitch period candidate with respect to the decoded signal is unnecessary.

That is, one speech code sequence conversion apparatus according to the present invention is characterized in that the coding circuit on a second code sequence side includes the following pitch component calculation means. The pitch component calculation means is a pitch component calculation circuit which receives the pitch period of the first code sequence from a pitch component decoding circuit on a first code sequence side to obtain the pitch period included in the first code sequence as the pitch period included in the second code sequence for each sub-frame which is a time unit to code the pitch period of the second code sequence.

In another speech code sequence conversion apparatus, the coding circuit on the second code sequence side includes: either one of a pitch period interpolation circuit which receives the pitch period of the first code sequence from the pitch component decoding circuit on the first code sequence side and which calculates the pitch period from the pitch period in a sub-frame of the first code sequence and the pitch period in a sub-frame of the past for each sub-frame which is a time unit to code the pitch period of the second code sequence to interpolate the pitch periods, and a pitch period averaging circuit which averages the pitch periods; and a pitch component calculation circuit which obtains the calculated pitch period as the pitch period included in the second code sequence as pitch component calculation means.

In still further speech code sequence conversion apparatus, the coding circuit on the second code sequence side includes: a pitch period candidate generation circuit for receiving the pitch period of the first code sequence from the pitch component decoding circuit on the first code sequence side to produce the pitch period included in the first code sequence, and at least a plurality of pitch period candidates in the vicinity of the pitch period for each sub-frame which is a time unit to code the pitch period of the second code sequence; and a pitch component coding circuit for obtaining any one of the produced candidates as the pitch period included in the second code sequence as pitch component coding means.

Still further speech code sequence conversion apparatus is characterized in that the coding circuit on the second code sequence side includes the pitch component coding means. The pitch component coding means includes: either one of a pitch period interpolation circuit for receiving the pitch period of the first code sequence from the pitch component decoding circuit on the first code sequence side and for calculating the pitch period from the pitch period in the corresponding sub-frame of the first code sequence and the pitch period in the past sub-frame for each sub-frame which is the time unit to code the pitch period of the second code sequence to interpolate the pitch period, and a pitch period averaging circuit for averaging the pitch period; a pitch period candidate generation circuit for producing the calculated pitch period and at least a plurality of pitch periods in the vicinity of the pitch period as the pitch period candidates; and a pitch component coding circuit for obtaining any one of the produced candidates as the pitch period included in the second code sequence.

The pitch component coding circuit in the above-described last two speech code sequence conversion apparatuses may select the pitch period included in the second code sequence so as to minimize a distance between either speech signals or excitation signals decoded from the first and second code sequences for each sub-frame.

Furthermore, the following LP coefficient coding means is applied in the speech code sequence conversion apparatus according to the present invention.

As one means, the coding circuit on the second code sequence side includes an LP coefficient coding circuit for receiving a spectrum characteristic of the first code sequence from an LP coefficient decoding circuit on the first code sequence side and for obtaining the spectrum characteristic included in the first code sequence as the spectrum characteristic included in the second code sequence for each frame which is the time unit to code the spectrum characteristic of the second code sequence. For each frame, a circuit for interpolating or averaging the LP coefficient to calculate the spectrum characteristic from the spectrum characteristic in the corresponding frame of the first code sequence and the spectrum characteristic of the past frame; and an LP coefficient coding circuit for obtaining the calculated spectrum characteristic may be disposed as the spectrum characteristic included in the second code sequence as LP coefficient coding means.

Moreover, as another means, for each frame of the second code sequence, a band expansion conversion circuit for converting a band expansion intensity of the spectrum characteristic included in the first code sequence; and an LP coefficient coding circuit for obtaining the converted/obtained spectrum characteristic as the spectrum characteristic included in the second code sequence are disposed as LP coefficient coding means.

Furthermore, as another means, for each frame which is the time unit to code the spectrum characteristic of the second code sequence, a circuit for interpolating or averaging the LP coefficient to calculate the spectrum characteristic from the spectrum characteristic in the corresponding frame of the first code sequence and the spectrum characteristic of the past frame; a band expansion conversion circuit for converting the band expansion intensity of the calculated spectrum characteristic; and an LP coefficient coding circuit for obtaining the converted/obtained spectrum characteristic as the spectrum characteristic included in the second code sequence may be disposed as the LP coefficient coding means.

BEST MODE FOR CARRYING OUT THE INVENTION

The present invention will be described with reference to the accompanying drawings in more detail.

Figure 2:
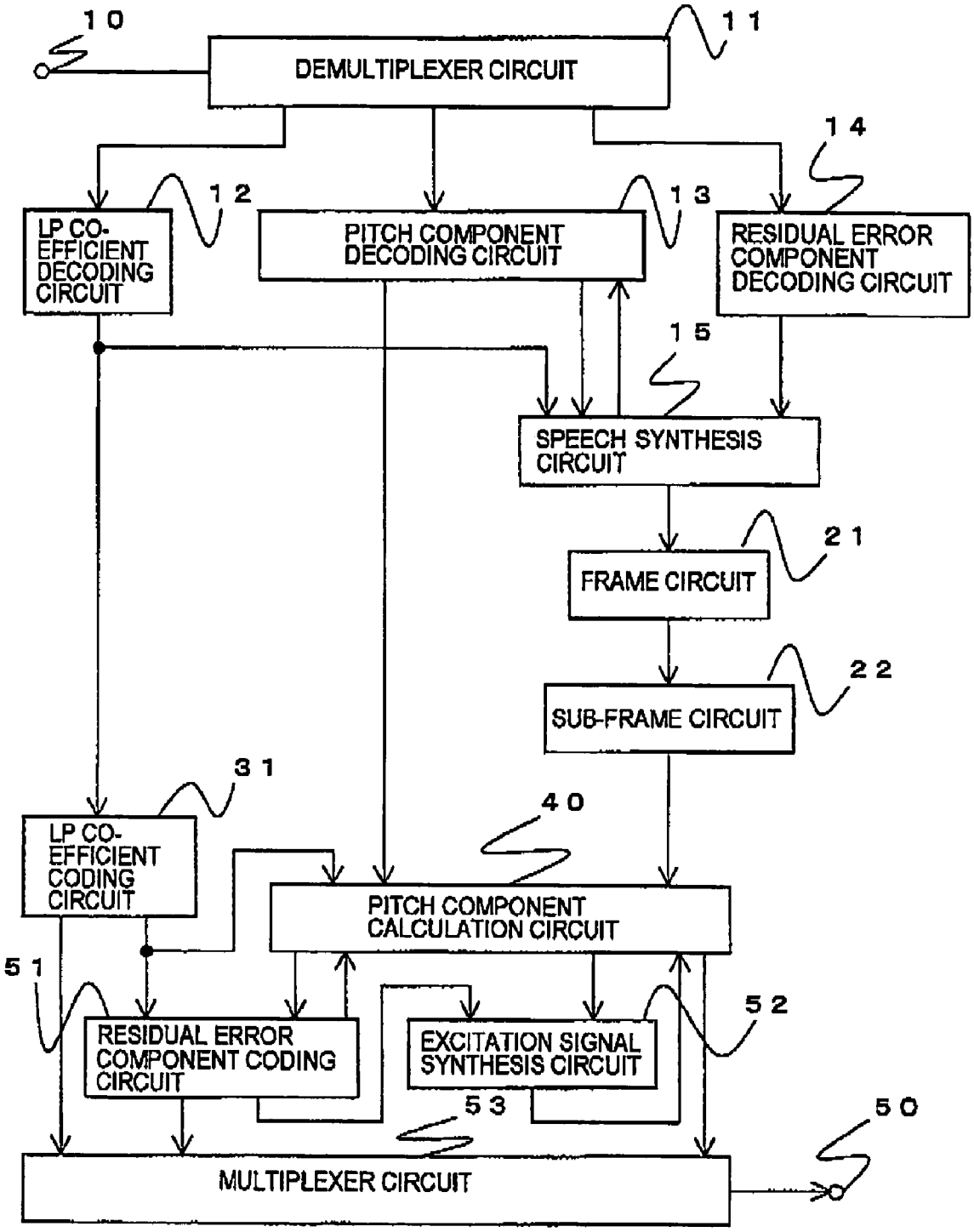
FIG. 2 is a diagram showing one embodiment of the circuit constitution according to the present invention.

FIG. 2 is a diagram showing one embodiment of a function block in the present invention. In this mode, a frame length and sub-frame length of a CELP system A agree with those of a CELP system B.

For a shown conversion apparatus of a speech code sequence, an input terminal 10, demultiplexer circuit 11, LP coefficient decoding circuit 12, pitch component decoding circuit 13, residual error component decoding circuit 14, and speech synthesis circuit 15 are disposed for decoding processing of the CELP system A. A frame circuit 21, sub-frame circuit 22, LP coefficient coding circuit 31, pitch component calculation circuit 40, residual error component coding circuit 51, excitation signal synthesis circuit 52, multiplexer circuit 53, and output terminal 50 are disposed to carry out coding processing of the CELP system B.

Figure 1:
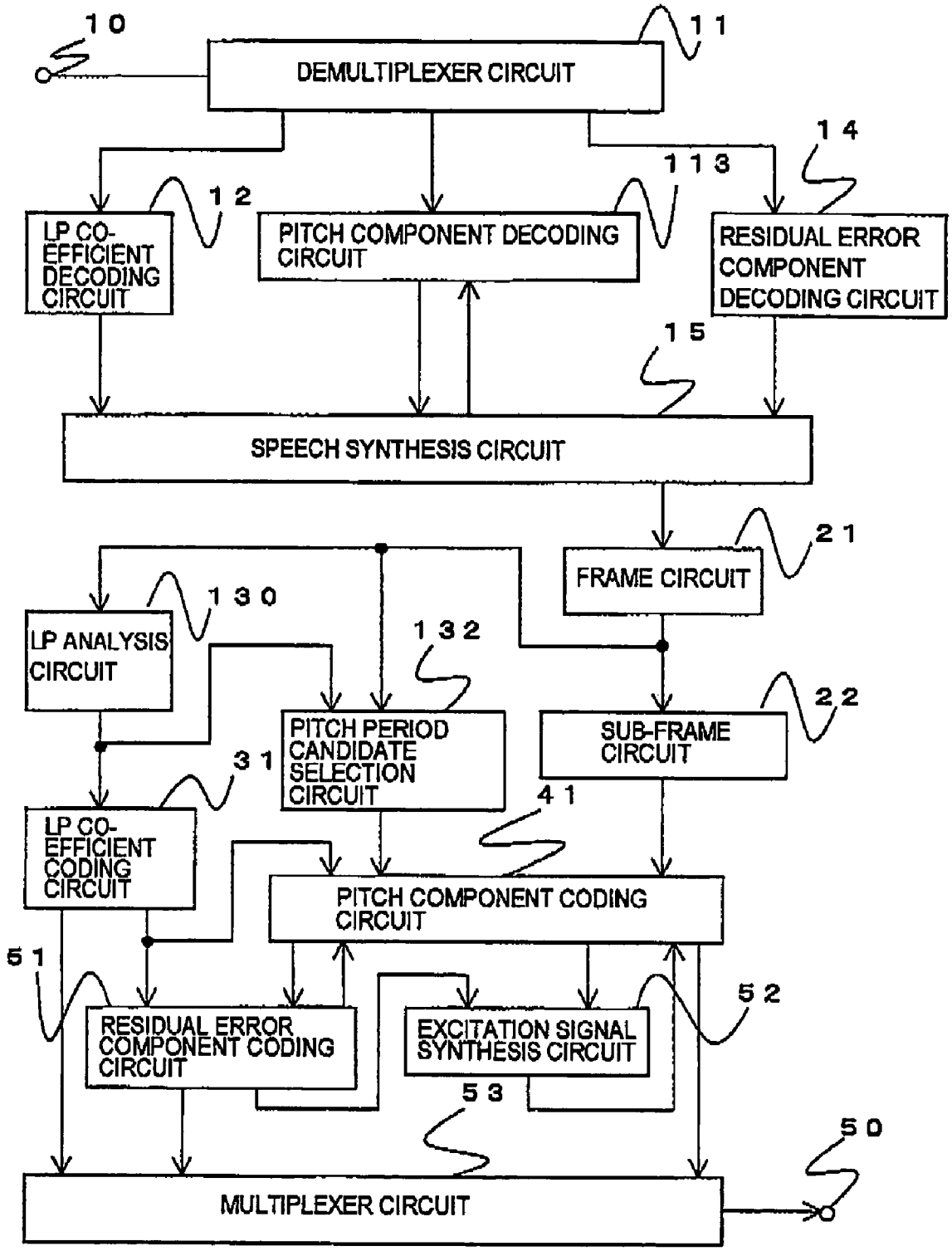
FIG. 1 is a diagram showing one example of a conventional circuit constitution.

Respects different from those in FIG. 1 referred to as a conventional conversion apparatus lie in that the LP analysis circuit 130 and pitch period candidate selection circuit 132 are removed, the pitch component decoding circuit 113 is changed to the pitch component decoding circuit 13, and the pitch component coding circuit 41 is changed to the pitch component calculation circuit 40.

In the code sequence conversion apparatus, the input terminal 10 inputs the code sequence of the CELP system A, and transfers the sequence to the demultiplexer circuit 11. The demultiplexer circuit 11 separates the code sequence transferred from the input terminal 10, transfers the code of a quantized LP coefficient to the LP coefficient decoding circuit 12, transfers the code of a pitch component to the pitch component decoding circuit 13, and further transfers the code of a residual error component signal to the residual error component decoding circuit 14.

The LP coefficient decoding circuit 12 uses the code transferred from the demultiplexer circuit 11 to decode the LP coefficient indicating a spectrum characteristic, and transfers the decoded coefficient to the speech synthesis circuit 15 and LP coefficient coding circuit 31. The pitch component decoding circuit 13 decodes a pitch period L and pitch gain ga from the code transferred from the demultiplexer circuit 11. The pitch component decoding circuit 13 is different from the pitch component decoding circuit 113 of FIG. 1 only in that the pitch period L is transferred to the pitch component calculation circuit 40. The circuit further accumulates the excitation signal transferred from the speech synthesis circuit 15 up to a sample for the past pitch period L, and traces back and cuts out the accumulated excitation signals to the past for the pitch period L to prepare an adaptive code vector Ca. Finally, a pitch component signal Ea (=ga·Ca) is calculated, and transferred to the speech synthesis circuit 15.

The residual error component decoding circuit 14 uses the code transferred from the demultiplexer circuit 11 to decode a speech source code vector Cr and speech source gain gr, calculates a residual error component signal Er (=gr·Cr), and transfers the signal to the speech synthesis circuit 15. The speech synthesis circuit 15 uses the pitch component signal Ea transferred from the pitch component decoding circuit 13 and the residual error component signal Er transferred from the residual error component decoding circuit 14 to calculate an excitation signal vector Ex of Equation 1 described above, and transfers a result to the pitch component decoding circuit 13. Furthermore, the speech synthesis circuit 15 filters the excitation signal vector Ex with a synthesis filter H(z) constituted of an LP coefficient a(i) transferred from the speech synthesis circuit 15 by Equation 2 described above to obtain an decoded signal vector Sd, and transfers the vector to the frame circuit 21.

The frame circuit 21 cuts the decoded signal transferred from the speech synthesis circuit 15 by a frame length of the CELP system B, and transfers the signals to the sub-frame circuit 22. The sub-frame circuit 22 divides the decoded signal transferred from the frame circuit 21 into sub-frame lengths of the CELP system B, and transfers the signals to the pitch component calculation circuit 40.

The LP coefficient coding circuit 31 quantizes the LP coefficient transferred from the LP coefficient decoding circuit 12, and transfers the code to the multiplexer circuit 53. Furthermore, the LP coefficient coding circuit 31 transfers the quantized LP coefficient to the pitch component calculation circuit 40 and residual error component coding circuit 51.

The pitch component calculation circuit 40 traces back the excitation signal transferred from the excitation signal synthesis circuit 52 and decoded in the past for time L and cuts out the signal by a sub-frame length to produce an adaptive code vector. Next, the pitch component calculation circuit 40 filters this adaptive code vector by Equation 2 described above, and calculates a decoded signal Sa(L) only of the pitch component. Furthermore, the pitch component calculation circuit 40 uses Equation 3 described above to load the decoded signal vector Sd and pitch period component vector Sa(L), and obtains a load decoded signal vector Sdw and load pitch period component vector Saw(L).

The pitch component calculation circuit 40 uses these values to calculate a pitch gain ga(L) by Equation 5 described above. Finally, the pitch component calculation circuit 40 transfers the code obtained by scalar quantization of the pitch period L and pitch gain ga(L) to the multiplexer circuit 53. A pitch component signal E'a calculated by a product of a quantized pitch gain gaq(L) and adaptive code vector Caq(L) is transferred to the excitation signal synthesis circuit 52.

The residual error component coding circuit 51 codes a residual error component of the decoded signal vector Sd transferred from the pitch component calculation circuit 40 for each sub-frame, and transfers the code to the multiplexer 53.

First, the residual error component coding circuit 51 takes a k-th speech source code vector Cr(k) from the pre-designed and accumulated speech source codebook. Next, the residual error component coding circuit 51 filters the speech source code vector by Equation 2 described above, and calculates a decoded signal Sr(k) of only the residual error component. Furthermore, the residual error component coding circuit 51 uses Equation 3 described above to load the decoded signal vector Sd and residual error component vector Sr(k), and obtains the load decoded signal vector Sdw and load residual error component vector Srw(k).

The residual error component coding circuit 51 performs the operation concerning the above-described residual error component with respect to all the speech source code vectors accumulated in the speech source codebook, and calculates a square distance Dr between the residual error signal vector Sdw' and load residual error component vector Srw(k) transferred from the pitch component calculation circuit 40 using Equation 6 described above to determine a code ko of the speech source code vector so as to minimize the distance.

Finally, the residual error component coding circuit 51 scalar-quantizes an optimum speech source gain gr(ko), and transfers the code and the code ko of the speech source code vector to the multiplexer circuit 53. The residual error component coding circuit 51 transfers a residual error component excitation signal E'r obtained by integrating a selected speech source code vector Cr(ko) with the quantized optimum speech source gain grq(ko) to the excitation signal synthesis circuit 52.

The excitation signal synthesis circuit 52 calculates an excitation signal Ex' by Equation 8 described above for adding a pitch component excitation signal E'a transferred from the pitch component calculation circuit 40 and the residual error component excitation signal E'r transferred from the residual error component coding circuit 51, and transfers the signal to the pitch component calculation circuit 40.

The multiplexer circuit 53 connects the LP coefficient, the pitch period, the pitch gain, the speech source codebook, and the code of the speech source gain to one another in a predetermined order, which have been transferred from the LP coefficient coding circuit 31, pitch component calculation circuit 40, and residual error component coding circuit 51, to produce the code sequence, and transfers the sequence to the output terminal 50. The output terminal 50 outputs the code sequence transferred from the multiplexer circuit 53.

Next, an embodiment separate from the above-described embodiment in the present invention will be described with reference to FIG. 3.

In this embodiment, band expansion conversion processing for correcting a difference of band expansion processing of a spectrum between the CELP systems A and B, and pitch period candidate generation processing for producing a candidate of the pitch period are added.

Figure 3:
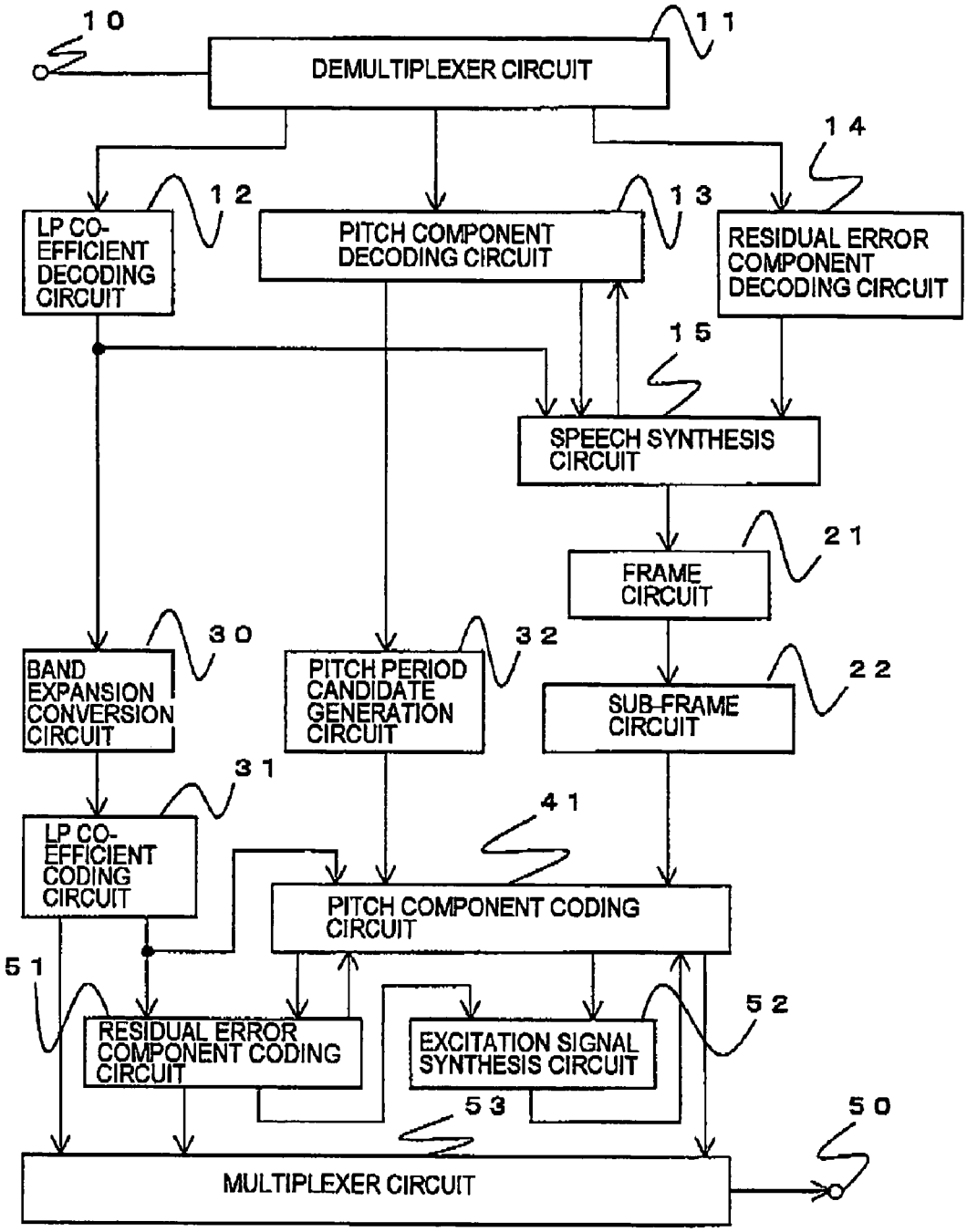
FIG. 3 is a diagram showing one embodiment of the circuit constitution different from that of FIG. 2 described above according to the present invention.

FIG. 3 is different from FIG. 2 in that a band expansion conversion circuit 30 and pitch period candidate generation circuit 32 are added and a pitch component coding circuit 41 described with reference to FIG. 1 is used instead of the pitch component calculation circuit 40. The band expansion conversion circuit 30 is positioned between the LP coefficient decoding circuit 12 and LP coefficient coding circuit 31. The pitch period candidate generation circuit 32 is positioned between the pitch component decoding circuit 13 and pitch component coding circuit 41.

In FIG. 3, the same constituting elements as those of FIG. 2 are denoted with the same reference numerals and description thereof is omitted. Therefore, the band expansion conversion circuit 30 and pitch period candidate generation circuit 32 associated with these processes will next be described.

The band expansion processing is a process of integrating a window function w(i) such as an index window with a self correlation function r(i) to obtain "w(j)·r(i)" in calculating the LP coefficient a(i) from the self correlation function r(i) of the input signal in order to prevent a steep peak from being generated by the spectrum characteristic. Since the window function w(i) differs with the coding system, this difference is corrected in the code sequence conversion, and accordingly deterioration by the conversion can be reduced. The pitch period candidate generation processing is a process of selecting the period from the pitch period and the neighboring pitch period instead of using the pitch period decoded in the CELP system A as such in the CELP system B. In this processing, as compared with the use of the pitch period as such, a calculation amount for determining the pitch period is necessary, but the deterioration by the conversion can be reduced.

The band expansion conversion circuit 30 calculates an impulse response of an LP filter constituted of the LP coefficient transferred from the LP coefficient decoding circuit 12, integrates the self correlation function of this impulse response with an inverse number of a band expansion coefficient wa(i) of the CELP system A, and further integrates a band expansion coefficient wb(i) of the CELP system B. Next, the band expansion conversion circuit 30 calculates the LP coefficient from the self correlation function by Levinson-Durbin method, and transfers the coefficient to the LP coefficient coding circuit 31.

The pitch period candidate generation circuit 32 transfers the pitch period L transferred from the pitch component decoding circuit 13 and the neighboring pitch period as the pitch period candidates to the pitch component coding circuit 41. In the transferred pitch period, integer times of the pitch period L or a value of 1 for integer, or the value in the vicinity can also be included as the pitch period candidates in order to inhibit speech quality deterioration by the code sequence conversion.

The pitch component coding circuit 41 performs the same operation as that described in the conventional system, when the pitch period candidates are transferred from the pitch period candidate generation circuit 32. At this time, in order to reduce the calculation amount and to omit the filtering by Equation 2 described above and the load by Equation 3 described above, the pitch component coding circuit 41 can use an optimum pitch gain G'a(L) calculated for each delay to determine an optimum pitch period Lo so that a square distance D'a between the excitation signal Ex calculated by the speech synthesis circuit 15 and the adaptive code vector Ca(L) is minimized.

The square distance D'a is obtained using the following equation 9, and the optimum pitch gain G'a(L) is obtained using the following equation 10.

$$D'a=|Ex-G'a(L)\cdot Ca(L)| \tag{9}$$

$$G'a(L)=\langle Ex, C'a(L)\rangle/|C'a(L)| \tag{10}$$

Next, an embodiment other than the above-described embodiments according to the present invention will be described with reference to FIG. 4.

In this embodiment, a frame length Na and sub-frame length Nsa of the CELP system A are longer than a frame length Nb and sub-frame length Nsb of the CELP system B, respectively. This embodiment is different from the second embodiment in processes of adjusting the differences of the frame length and sub-frame length.

Figure 4:
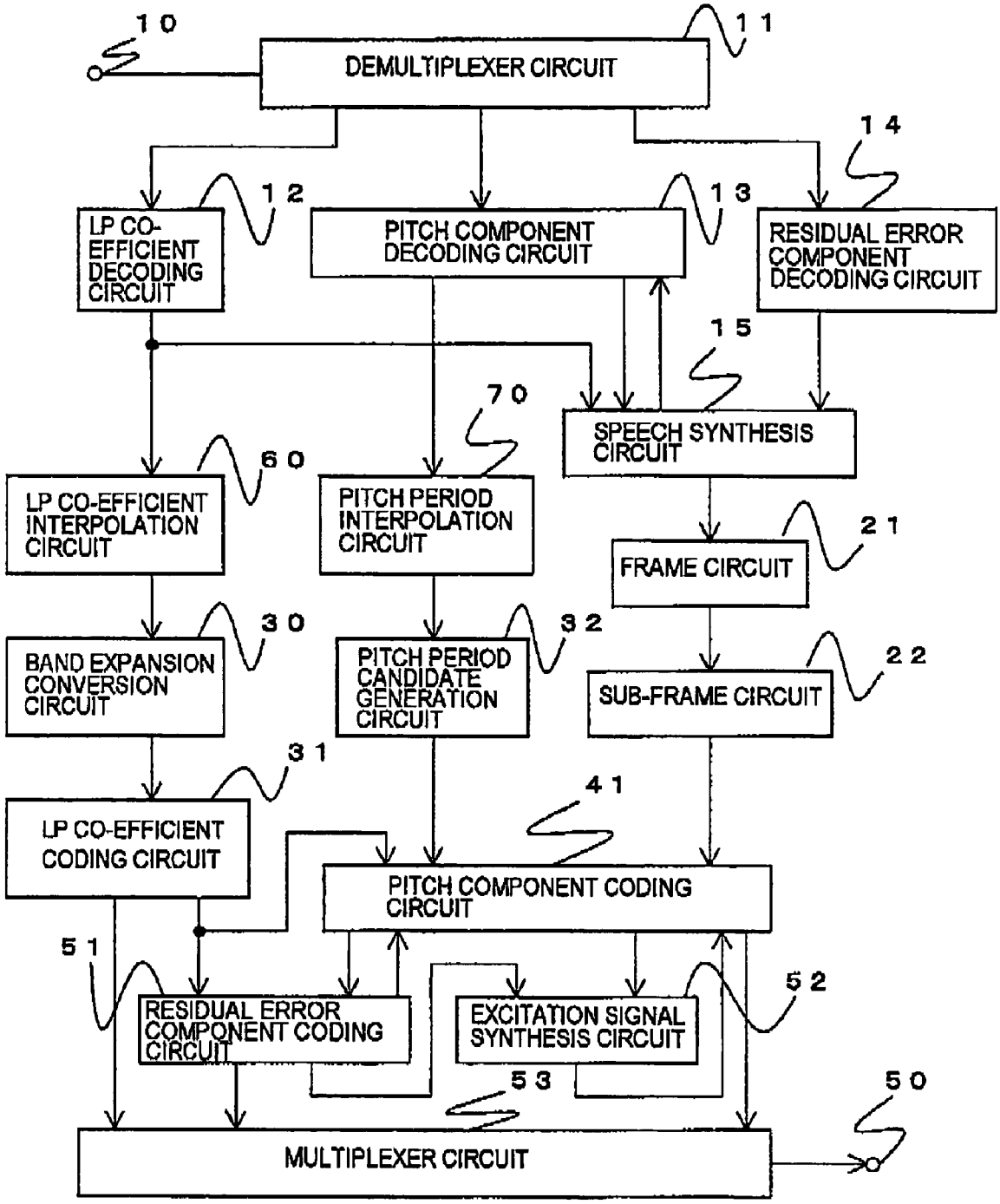
FIG. 4 is a diagram showing one embodiment of the circuit constitution different from those of FIGS. 2 and 3 described above according to the present invention.

FIG. 4 is different from FIG. 3 in that an LP coefficient interpolation circuit 60 and pitch period interpolation circuit 70 associated with these processes are added. The LP coefficient interpolation circuit 60 is positioned between the LP coefficient decoding circuit 12 and band expansion conversion circuit 30. The pitch period interpolation circuit 70 is positioned between the pitch component decoding circuit 13 and pitch period candidate generation circuit 32.

In FIG. 4, the same constituting elements as those of FIG. 3 are denoted with the same reference numerals and the description is omitted. Therefore, the added LP coefficient interpolation circuit 60 and pitch period interpolation circuit 70 will next be described.

Here, for concrete description, it is assumed that the frame length Na of the CELP system A is 20 ms and the sub-frame length Nsa is 10 ms and that the frame length Nb of the CELP system B is 10 ms and the sub-frame length Nsb is 5 ms. It is also assumed that the LP coefficient is calculated by an LP analysis window centering on the last sub-frame of each frame.

From the LP coefficient transferred from the LP coefficient decoding circuit 12 every 20 ms which is the frame length Na, and the LP coefficient transferred from the past frame, the LP coefficient interpolation circuit 60 calculates the LP coefficient of the frame length Nb for use in the CELP system B every 10 ms, and transfers the coefficient to the band expansion conversion circuit 30.

Figure 5:
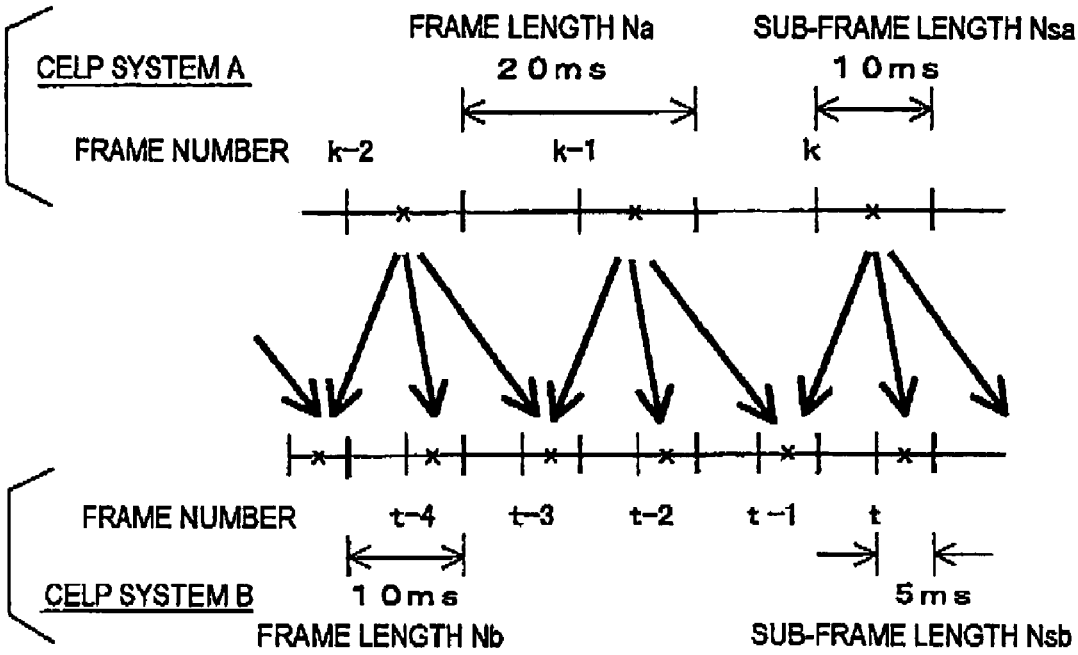
FIG. 5 is an explanatory view of interpolation processing of an LP coefficient in the present invention.

FIG. 5 is a diagram showing a relation between the LP coefficients of the CELP systems A and B. Shown X mark indicates a center of the above-described LP analysis window, and a center in the interpolation of the LP coefficient. A frame number is shown by "k" in the CELP system A, and by "t" in the CELP system B. An arrow indicates the LP coefficient of the CELP system B to be calculated with the use of the LP coefficient of the CELP system A.

The LP coefficient indicating the spectrum characteristic of the frame of the CELP system A is transferred from the LP coefficient decoding circuit 12 every 20 ms, but the LP coefficient is required in the CELP system B every 10 ms. Therefore, assuming that an order of arrows shown in FIG. 5 is "i=1, 2, . . . , or p", LP coefficients ab(t−1,i) and ab(t,i) of the CELP system B in frame numbers "t−1" and "t" are calculated following the following equations 11 and 12 using LP coefficient aa(k,i) of the corresponding frame in the CELP system A, and LP coefficient aa(k−j,i) in the frame traced back to the past by j frames. In the calculation, a load function w(j) which defines an interpolation method is used. Moreover, in consideration of a positional relation of X marks in the example shown in FIG. 5, with the LP coefficient ab(t−1,i) in Equation 11, "w(0)=⅝, w(1)=⅜" and "M=2" are applied. With the LP coefficient ab(t,i) in Equation 12, "w(0)=1" and "M=1" are applied.

$$ab(t-1, i)=w(0)\cdot aa(k, i)+w(1)\cdot aa(k-1, i)+\ldots+w(M-1)\cdot aa(k-M+1, i) \tag{11}$$

$$ab(t, i)=w(0)\cdot aa(k, i)+w(1)\cdot aa(k-1, i)+\ldots+w(M-1)\cdot aa(k-M+1, i) \tag{12}$$

The pitch period interpolation circuit 70 calculates the pitch period every 5 ms which is the sub-frame length Nsb for use in the CELP system B from the pitch period transferred from the pitch component decoding circuit 13 every 10 ms of the sub-frame length Nsa and the pitch period transferred in the past sub-frame, and transfers the pitch period to the pitch period candidate generation circuit 32.

Figure 6:
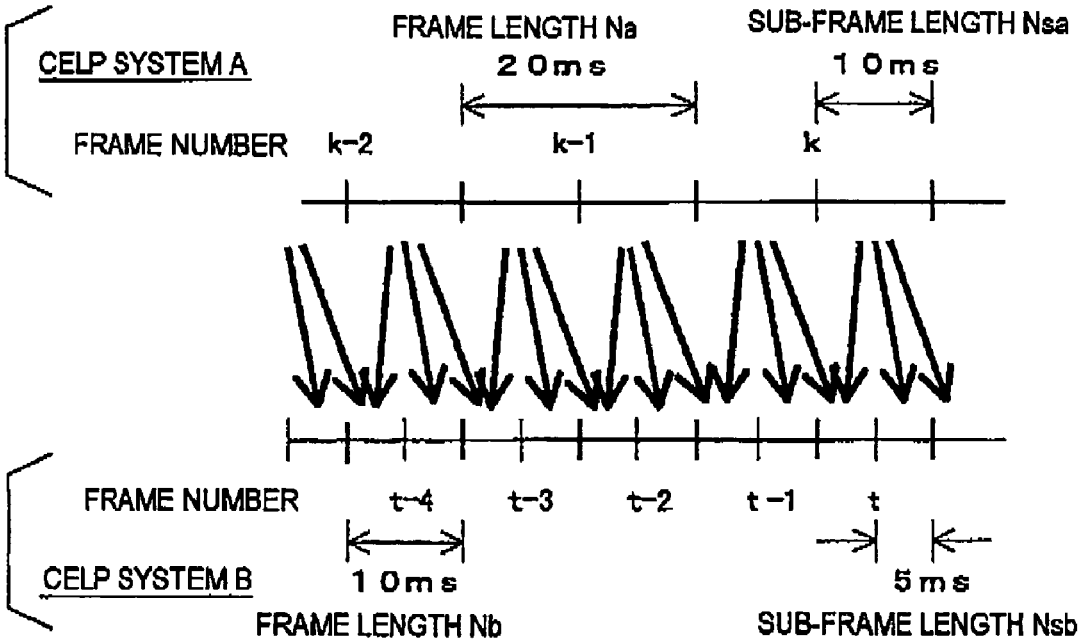
FIG. 6 is an explanatory view of the interpolation processing of a pitch period in the present invention.

FIG. 6 is a diagram showing the relation between the pitch periods of the CELP systems A and B. As shown, the frame number is shown by "k" in the CELP system A, and by "t" in the CELP system B. The arrow indicates the pitch period of the CELP system B to be calculated with the use of the pitch period of the CELP system A.

The pitch period of the sub-frame of the CELP system A is transferred from the pitch component decoding circuit 13 every 10 ms. However, the pitch period is required in the CELP system B every 5 ms. Therefore, as shown by the arrows of FIG. 6, for pitch periods L1*b*(t) and L2*b*(t) of the CELP system B in the first and second sub-frames of the frame number "t", pitch periods L1*a*(k) and L2*a*(k) of the corresponding frame in the CELP system A and pitch periods L1*a*(k−j) and L2*a*(k−j) in the frame traced back to the past by j frames are used to calculate a pitch period Lsb(t) by the following equation 13. In the calculation, a load function u(j) which defines the interpolation method is used.

$$Lsb(t)=u(0)\cdot L1a(k)+u(1)\cdot L2a(k)+\ldots+u(M-2)\cdot L1a(k-M/2+1)+u(M-1)\cdot L1a(k-M/2+1) \quad (13)$$

Moreover, in consideration of the positional relation of the sub-frames between both the CELP systems in the example shown in FIG. 6, when the pitch period Lsb(t) in Equation 13 is the pitch period L1*b*(t), "u(0)=¾, u(1)=¼" and "M=2" are applied. When the pitch period Lsb(t) is the pitch period L2*b*(t), "u(0)=1" and "M=1" are applied.

Next, an embodiment other than the above-described embodiments according to the present invention will be described with reference to FIG. 7.

In this embodiment, in the same manner as in the embodiment described above with reference to FIG. 4, the frame length Na and sub-frame length Nsa of the CELP system A are longer than the frame length Nb and sub-frame length Nsb of the CELP system B, respectively.

Therefore, the band expansion conversion processing for correcting the difference of the band expansion processing of the spectrum between the CELP systems A and B, and the pitch period candidate generation processing for producing the candidates of the pitch period are added.

Figure 7:
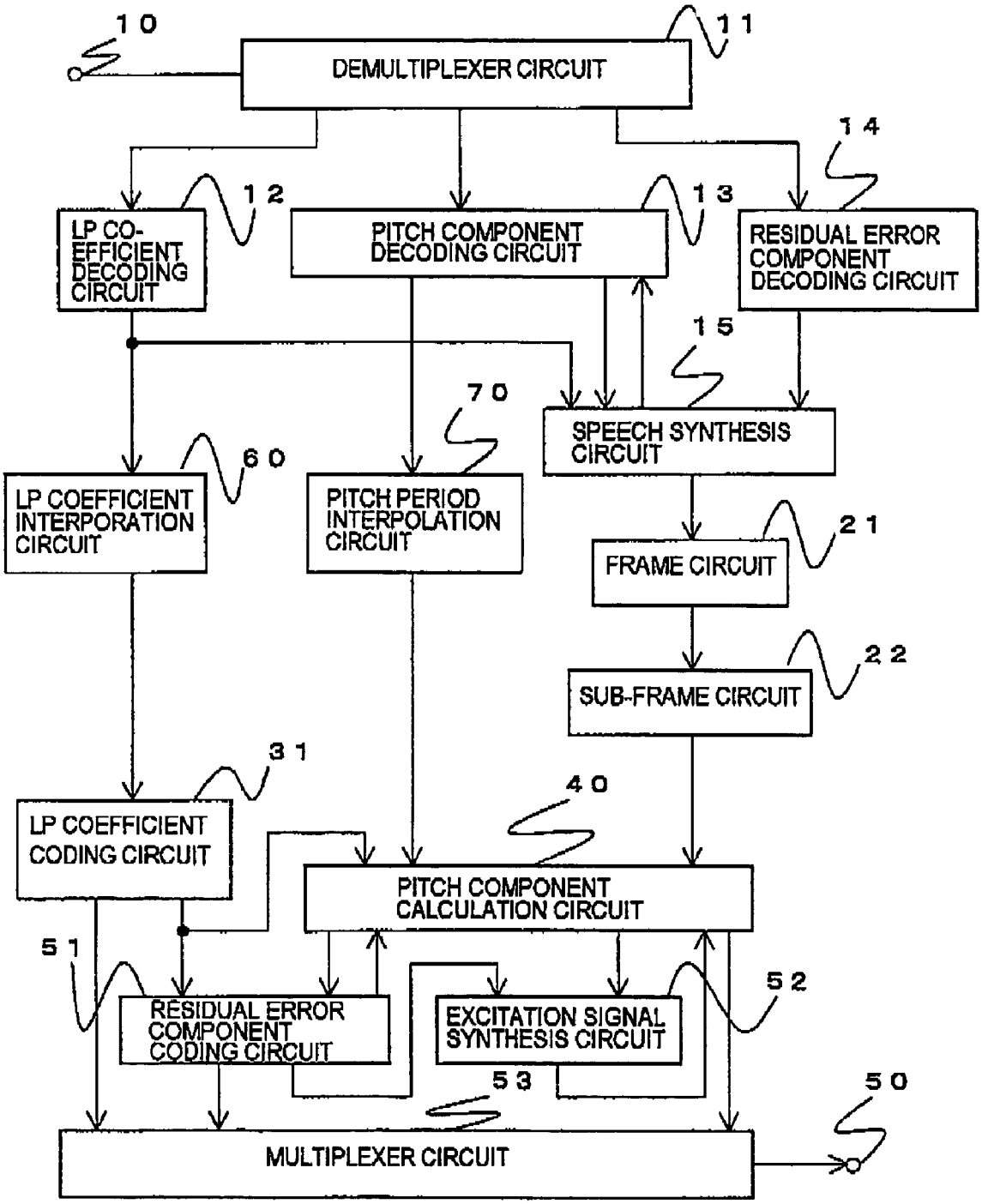
FIG. 7 is a diagram showing one embodiment of the circuit constitution different from those of FIGS. 2 to 4 described above according to the present invention.

That is, for FIG. 7, the LP coefficient interpolation circuit 60 and pitch period interpolation circuit 70 are added to FIG. 2. On the other hand, as compared with FIG. 4, the band expansion conversion circuit 30 and pitch period candidate generation circuit 32 are deleted, and the pitch component calculation circuit 40 described with reference to FIG. 2 is used instead of the pitch component coding circuit 41. Therefore, the LP coefficient interpolation circuit 60 is positioned between the LP coefficient decoding circuit 12 and LP coefficient coding circuit 31. The pitch period interpolation circuit 70 is positioned between the pitch component decoding circuit 13 and pitch component calculation circuit 40.

In FIG. 7, the same constituting elements as those of FIG. 2 are denoted with the same reference numerals and the description is omitted. The LP coefficient interpolation circuit 60 and pitch period interpolation circuit 70 are added to FIG. 2, but are the same in function as those described above with reference to FIGS. 4 to 6.

That is, the LP coefficient interpolation circuit 60 interpolates the LP coefficient transferred from the LP coefficient decoding circuit 12, and transfers the coefficient to the LP coefficient coding circuit 31. The pitch period interpolation circuit 70 interpolates the pitch period transferred from the pitch component decoding circuit 13, and transfers the pitch period to the pitch component calculation circuit 40.

Next, an embodiment different from the above-described embodiment according to the present invention will be described with reference to FIG. 8.

In this embodiment, the frame length Na and sub-frame length Nsa of the CELP system A are shorter than the frame length Nb and sub-frame length Nsb of the CELP system B, respectively. This embodiment is different from the embodiment described above with reference to FIG. 3 in that the processing for adjusting the differences of the frame length and sub-frame length is disposed, and different from the embodiment described above with reference to FIG. 4 in an adjustment processing method of the differences.

Figure 8:
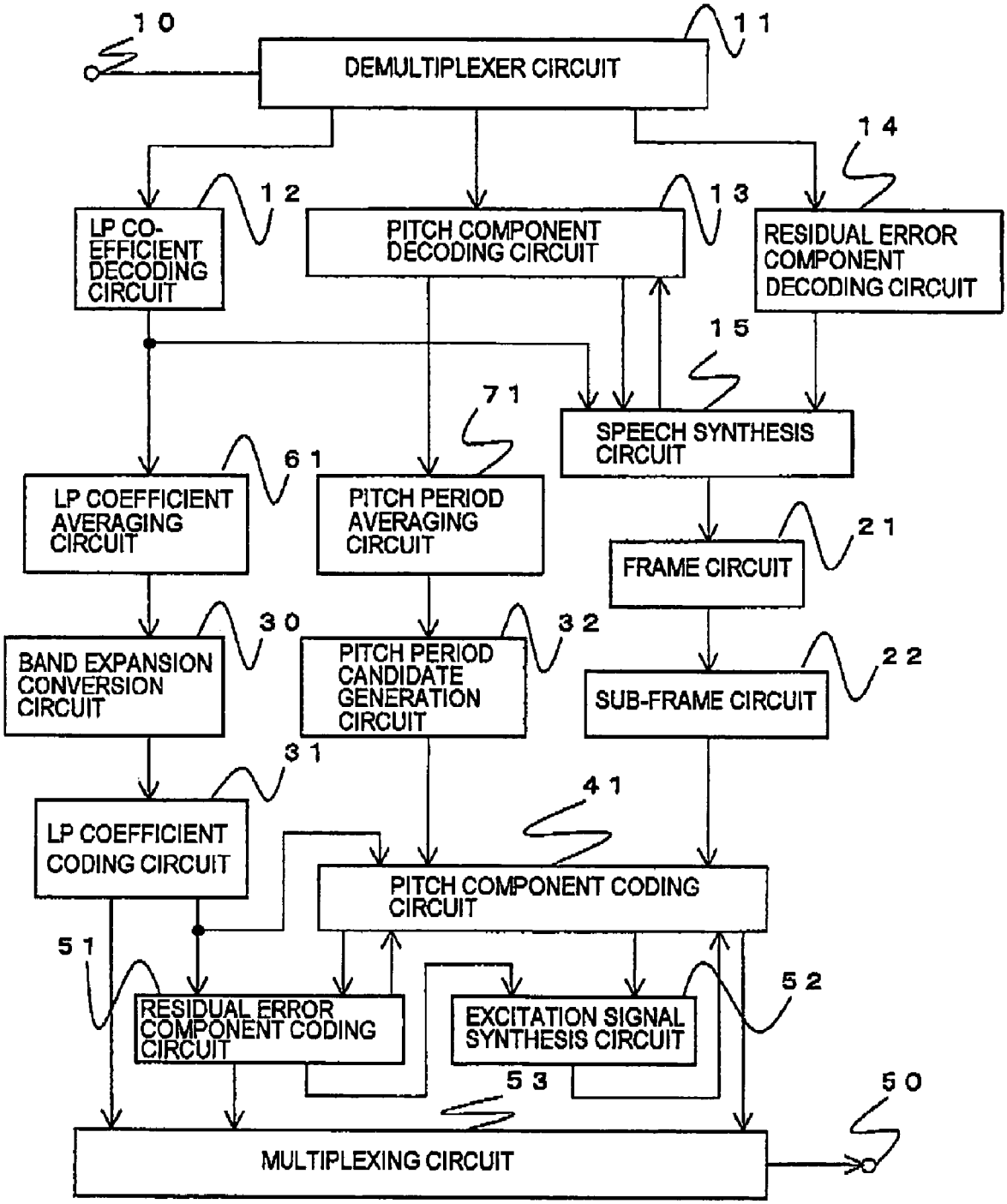
FIG. 8 is a diagram showing one embodiment of the circuit constitution different from those of FIGS. 2 to 4, or 7 described above according to the present invention.

That is, FIG. 8 is different from FIG. 3 in that processing circuits including an LP coefficient averaging circuit 61 and pitch period averaging circuit 71 are added. On the other hand, FIG. 8 is different from FIG. 4 in that the LP coefficient interpolation circuit 60 and pitch period interpolation circuit 70 associated with these processes in FIG. 4 are replaced with the LP coefficient averaging circuit 61 and pitch period averaging circuit 71, respectively. Therefore, the LP coefficient averaging circuit 61 is positioned between the LP coefficient decoding circuit 12 and band expansion conversion circuit 30. The pitch period averaging circuit 71 is positioned between the pitch component decoding circuit 13 and pitch period candidate generation circuit 32.

In FIG. 8, the same constituting elements as those of FIG. 4 are denoted with the same reference numerals and the description is omitted. Therefore, the replacing LP coefficient averaging circuit 61 and pitch period averaging circuit 71 will next be described.

Here, to concretize the description, it is assumed that the frame length Na of the CELP system A is 10 ms and the sub-frame length Nsa is 5 ms and that the frame length Nb of the CELP system B is 20 ms and the sub-frame length Nsb is 10 ms. It is also assumed that the LP coefficient is calculated by the LP analysis window centering on the last sub-frame of each frame The LP coefficient averaging circuit 61 calculates the LP coefficient every 20 ms which is the frame length Nb for use in the CELP system B from the LP coefficient transferred from the LP coefficient decoding circuit 12 every 10 ms which is the frame length Na and the LP coefficient transferred in the past frame, and transfers the coefficient to the band expansion conversion circuit 30.

Figure 9:
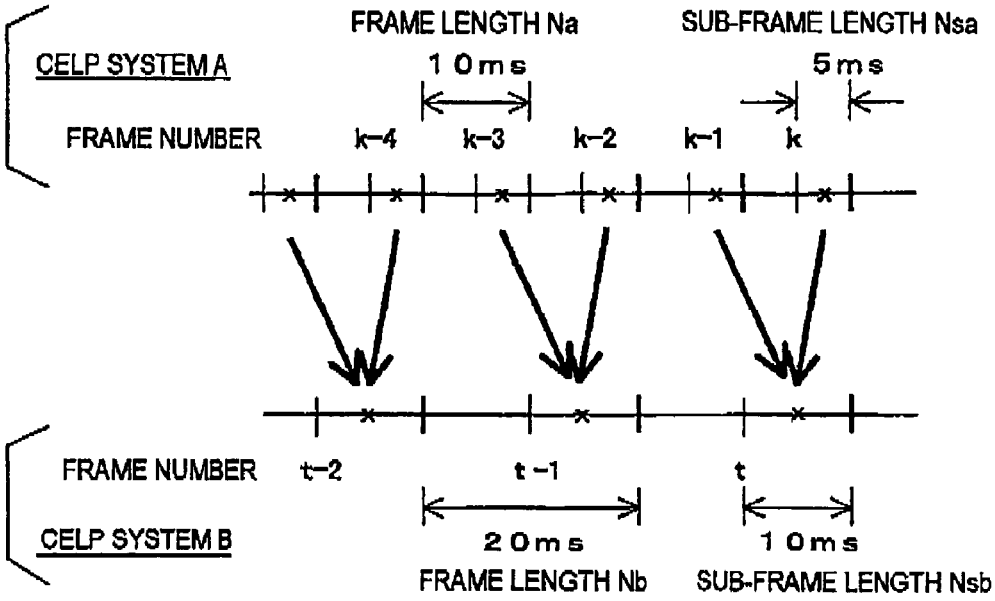
FIG. 9 is an explanatory view of averaging processing of the LP coefficient in the present invention.

Next, FIG. 9 is a diagram showing a relation between the LP coefficients of the CELP systems A and B. The shown X marks indicate the center of the above-described LP analysis window, and the center in the averaging of the LP coefficient. The frame number is shown by "k" in the CELP system A, and by "t" in the CELP system B. The arrow indicates the LP coefficient of the CELP system B to be calculated with the use of the LP coefficient of the CELP system A.

The LP coefficient indicating the spectrum characteristic of the frame of the CELP system A is transferred from the LP coefficient decoding circuit 12 every 10 ms, but the LP coefficient is required in the CELP system B every 20 ms. Therefore, assuming that the order "i" of the arrows shown in FIG. 9 is "i=1, 2, . . . , or p", the LP coefficient ab(t,i) of the CELP system B in the frame number "t" is calculated following Equation 12 described above using the LP coefficient aa(k,i) of the corresponding frame in the CELP system A and the LP coefficient aa(k−j,i) in the frame traced back to the past by j frames. In the calculation, the load function w(j) which defines an averaging method is used. Moreover, in consideration of the positional relation-of the X marks in the example shown in FIG. 9, with the LP coefficient ab(t,i) in Equation 12, "w(0)=¾, w(1)=¼" and "M=2" are applied.

The pitch period averaging circuit 71 calculates the pitch period every 5 ms which is the sub-frame length Nsb for use in the CELP system B from the pitch period transferred from the pitch component decoding circuit 13 every 10 ms which is the sub-frame length Nsa and the pitch period transferred in the past sub-frame, and transfers the pitch period to the pitch period candidate generation circuit 32.

Figure 10:
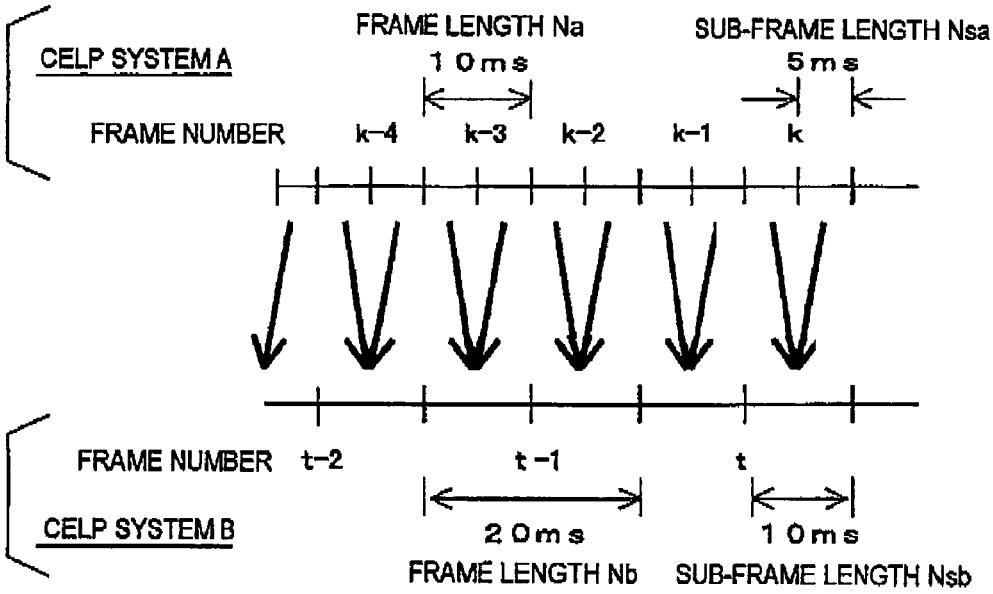
FIG. 10 is an explanatory view of the averaging processing of the pitch period in the present invention.

Next, FIG. 10 is a diagram showing the relation between the pitch periods of the CELP systems A and B. The frame number is shown by "k" in the CELP system A, and by "t" in the CELP system B. The arrow indicates the pitch period of the CELP system B to be calculated with the use of the pitch period of the CELP system A.

The pitch period of the sub-frame of the CELP system A is transferred from the pitch component decoding circuit 13 every 5.ms. However, the pitch period is required in the CELP system B every 10 ms. Therefore, as shown by the arrows of FIG. 10, for the pitch periods L1*b*(t) and L2*b*(t) of the CELP system B in the first and second sub-frames of the frame number "t", the pitch periods L1*a*(k) and L2*a*(k) of the corresponding frame in the CELP system A and the pitch periods L1*a*(k−j) and L2*a*(k−j) in the frame traced back to the past by j frames are used to calculate the pitch period Lsb(t) by Equation 13 described above.

In the calculation, the load function u(j) which defines the interpolation method is used. Moreover, in consideration of the positional relation of the sub-frames between both the CELP systems in the example shown in FIG. 10, when the pitch period Lsb(t) in Equation 13 is the pitch period L1*b*(t), "u(0)=½, u(1)=½" and "M=2" are applied. Similarly, when the pitch period is L2*b*(t), "u(0)=0, u(1)=0, u(2)=½, u(3)=1/2" and "M=4" are applied.

Next, an embodiment other than the above-described embodiments according to the present invention will be described with reference to FIG. 11.

In this embodiment, in the same manner as in the embodiment described above with reference to FIG. 8, the frame length Na and sub-frame length Nsa of the CELP system A are shorter than the frame length Nb and sub-frame length Nsb of the CELP system B, respectively. This embodiment is different from the embodiment described above with reference to FIG. 3 in that the processing for adjusting the differences of the frame length and sub-frame length is disposed. As compared with the embodiment described above with reference to FIG. 8, the adjustment processing method of the differences are different.

Figure 11:
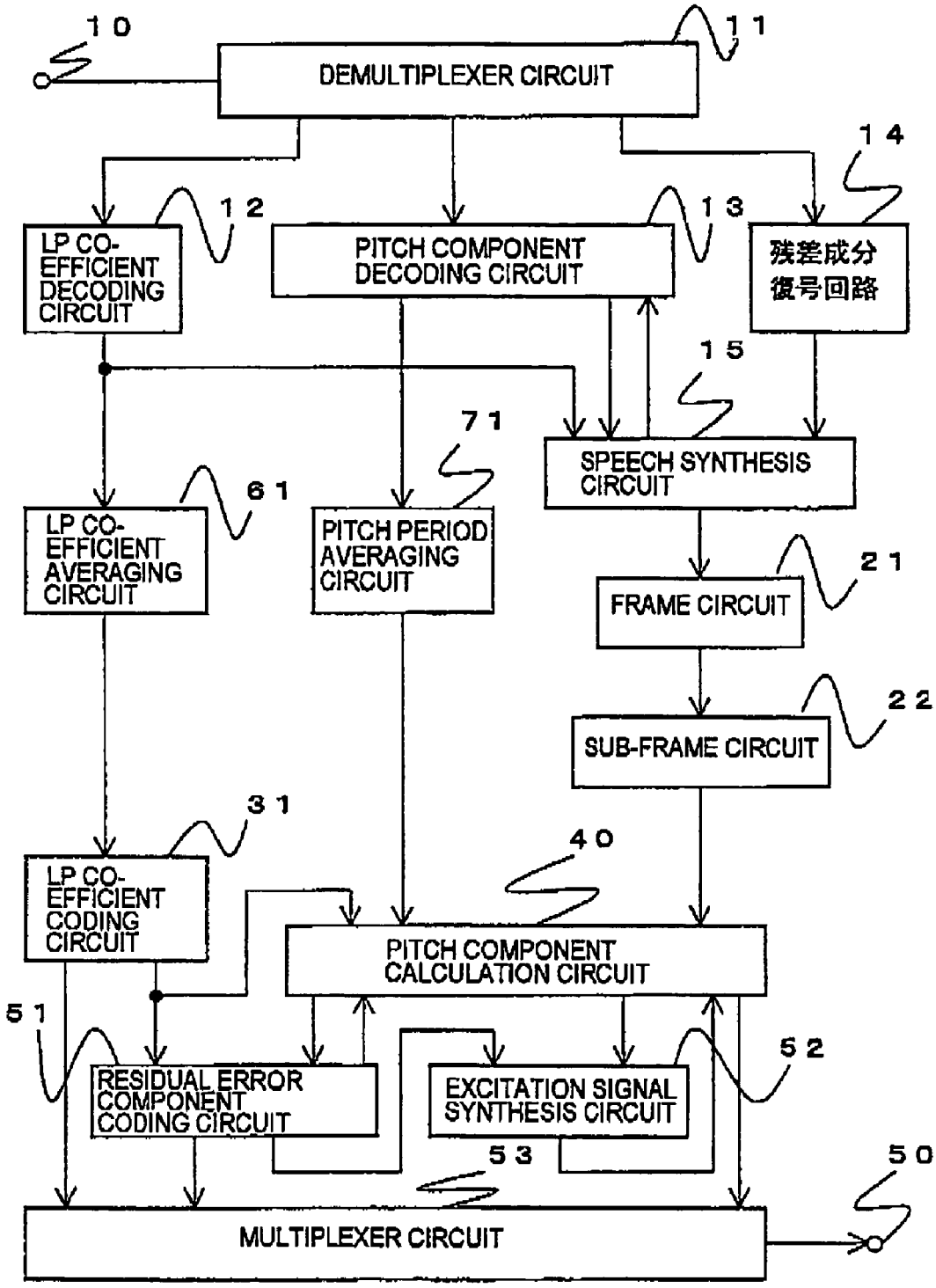
FIG. 11 is a diagram showing one embodiment of the circuit constitution different from those of FIGS. 2 to 4, or FIG. 7 or 8 described above according to the present invention.

That is, FIG. 11 is different from FIG. 2 in that the LP coefficient averaging circuit 61 and pitch period averaging circuit 71 are added. On the other hand, the respects different from those of FIG. 8 lie in that the band expansion conversion circuit 30 and pitch period candidate generation circuit 32 are deleted, and the pitch component calculation circuit 40 described with reference to FIG. 2 is used instead of the pitch component coding circuit 41. Therefore, the LP coefficient averaging circuit 61 is positioned between the LP coefficient decoding circuit 12 and LP coefficient coding circuit 31. The pitch period averaging circuit 71 is positioned between the pitch component decoding circuit 13 and pitch component calculation circuit 40.

In FIG. 11, the same constituting elements as those of FIG. 2 are denoted with the same reference numerals and the description is omitted. The LP coefficient averaging circuit 61 and pitch period averaging circuit 71 are added to FIG. 2, but are the same as those described with reference to FIGS. 8 to 10.

That is, in the same manner as in the fifth embodiment, the LP coefficient averaging circuit 61 averages the LP coefficients transferred from the LP coefficient decoding circuit 12, and transfers the coefficient to the LP coefficient coding circuit 31. The pitch period averaging circuit 71 averages the pitch periods transferred from the pitch component decoding circuit 13, and transfers the pitch period to the pitch component calculation circuit 40.

In the above description, the circuit constitution has been shown and referred to, but circuit functions can freely be separated or combined as long as the above-described functions are satisfied.

As described above, according to the present invention, the LP coefficient and pitch period decoded from the code sequence of the CELP system on the input side are directly used on the output side, and are code-converted not via the decoded signal obtained by decoding the inputted code sequence. Therefore, the need for LP analysis and the selection of the pitch period candidate which have heretofore been performed with reference to the decoded signal on the input side can be obviated, and therefore the code sequence conversion by the calculation amount smaller than that of the conventional system is possible.

INDUSTRIAL APPLICABILITY

As described above, an apparatus and method according to the present invention are suitable for those for speech code sequence conversion in which in speech communication performed between two types of speech coding systems, a speech code sequence obtained by the coding of one system can be converted to a speech code sequence which can be decoded by the other system with small strain and calculation amount.

The invention claimed is:

1. A speech code sequence conversion apparatus comprising:

a decoding circuit for a first code sequence, which separates and decodes the first code sequence into components including i) a quantization linear prediction (LP) coefficient, ii) a pitch period, and iii) a residual error component signal, and speech synthesizes the components to produce a decoded signal; and a coding circuit for a second code sequence, which i) cuts the decoded signal by a frame length of a second code sequence including the pitch period, ii) further divides the frame length into sub-frame lengths of the second code sequence, iii) vector-quantizes the LP coefficient of the first code sequence to produce a quantized LP coefficient, iv) codes a pitch component into an optimum pitch, and v) codes and synthesizes calculated and obtained residual error components, to output a coded signal, wherein the coding circuit includes pitch component coding means for i) receiving the pitch period of the first code sequence from a pitch component decoding circuit of the decoding circuit, and for ii) producing the pitch period of the first code sequence and a plurality of pitch period candidates in a vicinity of the pitch period of the first code sequence, for each sub-frame length that is a time unit to code a pitch period of the second code sequence, as the pitch period candidates of the second code sequence.

2. The code sequence conversion apparatus according to claim 1, wherein the pitch component coding means selects the pitch period of the second code sequence from the plurality of pitch period candidates for each sub-frame length of the second code sequence so as to minimize a distance between one of i) speech signals decoded from the first and second code sequences and ii) excitation signals decoded from the first and second code sequences.

3. A speech code sequence conversion apparatus comprising:

a decoding circuit for a first code sequence, which separates and decodes the first code sequence into components including i) a quantization linear prediction (LP) coefficient, ii) a pitch period, and iii) a residual error component signal, and speech synthesizes the components to produce a decoded signal; and a coding circuit for a second code sequence, which i) cuts the decoded signal by a frame length of a second code sequence including the pitch period, ii) further divides the frame length into sub-frame lengths of the second code sequence, iii) vector-quantizes the LP coefficient of the first code sequence to produce a quantized LP coefficient, iv) codes a pitch component into an optimum pitch, and v) codes and synthesizes calculated and obtained residual error components, to output a coded signal, wherein the coding circuit includes pitch component coding means for receiving the pitch period of the first code sequence from a pitch component decoding circuit of the decoding circuit, and for obtaining one of i) a calculated pitch period calculated from a first pitch period in a sub-frame length of the first code sequence and a second pitch period of a past sub-frame length of the first code sequence, and ii) a plurality of pitch periods in a vicinity of the calculated pitch period, as the pitch period of the second code sequence for each sub-frame length that is a time unit to code a pitch period of the second code sequence.

4. The code sequence conversion apparatus according to claim 3, wherein the pitch component coding means selects the pitch period of the second code sequence for each sub-frame length of the second code sequence so as to minimize a distance between one of i) speech signals decoded from the first and second code sequences and ii) excitation signals decoded from the first and second code sequences.

5. A speech code sequence conversion apparatus comprising:

a decoding circuit for a first code sequence, which separates and decodes the first code sequence into components including i) a quantization linear prediction (LP) coefficient, ii) a pitch period, and iii) a residual error component signal, and speech synthesizes the components to produce a decoded signal; and a coding circuit for a second code sequence, which i) cuts the decoded signal by a frame length of a second code sequence including the pitch period, ii) further divides the frame length into sub-frame lengths of the second code sequence, iii) vector-quantizes the LP coefficient of the first code sequence to produce a quantized LP coefficient, iv) codes a pitch component into an optimum pitch, and v) codes and synthesizes calculated and obtained residual error components, to output a coded signal, wherein the coding circuit includes LP coefficient coding means for i) receiving a spectrum characteristic of the first code sequence from the decoding circuit, and for ii) converting a band expansion intensity of the spectrum characteristic of the first code sequence as an output spectrum characteristic of the second code sequence for each frame length of the second code sequence.

6. A speech code sequence conversion apparatus comprising:

a decoding circuit for a first code sequence, which separates and decodes the first code sequence into components including i) a quantization linear prediction (LP) coefficient, ii) a pitch period, and iii) a residual error component signal, and speech synthesizes the components to produce a decoded signal; and a coding circuit for a second code sequence, which i) cuts the decoded signal by a frame length of a second code sequence including the pitch period, ii) further divides the frame length into sub-frame lengths of the second code sequence, iii) vector-quantizes the LP coefficient of the first code sequence to produce a quantized LP coefficient, iv) codes a pitch component into an optimum pitch, and v) codes and synthesizes calculated and obtained residual error components, to output a coded signal, wherein the coding circuit includes LP coefficient coding means for i) receiving a spectrum characteristic of the first code sequence from the decoding circuit, and for ii) converting a band expansion intensity of the spectrum characteristic, calculated from a first spectrum characteristic in a frame length of the first code sequence and a second spectrum characteristic of a past frame length, as the spectrum characteristic of the second code sequence for each frame length that is a time unit to code a spectrum characteristic of the second code sequence.

7. A code sequence conversion method of converting a first code sequence into a second code sequence, the method comprising the steps of:

extracting a pitch period from a first code sequence and a plurality of pitch periods in the vicinity of the pitch period as pitch period candidates for each sub-frame of a second code sequence that is a time unit to code a pitch period of the second code sequence; and obtaining any one of the pitch period candidates as the pitch period of the second code sequence.

8. The code sequence conversion method according to claim 7, further comprising the steps of:

decoding one of a speech signal and an excitation signal as a decoded signal from the first code sequence for each sub-frame; and selecting the pitch period of the second code sequence so as to minimize a distance between the decoded signal and a signal to be decoded from the second code sequence.

9. A code sequence conversion method of converting a first code sequence into a second code sequence, the method comprising the steps of:

calculating a calculated pitch period from a first pitch period of a sub-frame of a first code sequence and a second pitch period of a past sub-frame for each sub-frame of the second code sequence that is a time unit to code a pitch period of a second code sequence;

obtaining any of the calculated pitch period and at least one of i) a pitch period in a vicinity of the calculated pitch period, ii) a multiplied pitch period that is integer times the transferred pitch period and a vicinity pitch period in the vicinity of the transferred pitch period, and iii) a pitch period of one integer time and a plurality of pitch periods in the vicinity, as pitch period candidates; and obtaining any one of the pitch period candidates as the pitch period of the second code sequence.

10. The code sequence conversion method according to claim 9, further comprising the steps of:

decoding one of i) a speech signal from the first code sequence and ii) an excitation signal from the first code sequence for each sub-frame as a first decoded signal; and selecting the pitch period of the second code sequence so as to minimize a distance between the first decoded signal and a second decoded signal decoded from the second code sequence.

11. A code sequence conversion method of converting a first code sequence into a second code sequence, the method comprising:

converting a band expansion intensity of a spectrum characteristic included in a first code sequence for each frame of a second code sequence as a converted spectrum characteristic; and obtaining the converted spectrum characteristic as a spectrum characteristic of the second code sequence.

12. A code sequence conversion method of converting a first code sequence into a second code sequence, the method comprising the steps of:

calculating a calculated spectrum characteristic from a first spectrum characteristic in a frame of a first code sequence and a second spectrum characteristic in a past frame for each frame that is a time unit to code a spectrum characteristic of a second code sequence;

converting a band expansion intensity of the calculated spectrum characteristic as a converted spectrum characteristic; and obtaining the converted spectrum characteristic as a spectrum characteristic of the second code sequence.

* * * * *